United States Patent [19]

Shaw et al.

[11] 4,167,846

[45] Sep. 18, 1979

[54] STEEL ROTOR WITH HARDENED FIBRE COLLECTING GROOVE AND METHOD OF MANUFACTURE THEREOF

[75] Inventors: Jack Shaw, Burnley; John Whiteley, Clitheroe; Stephen Martin, Rossendale, all of England

[73] Assignee: Platt Saco Lowell Limited, United Kingdom

[21] Appl. No.: 879,913

[22] Filed: Feb. 22, 1978

[51] Int. Cl.[2] ..... D01H 1/12; C21D 9/00

[52] U.S. Cl. ..... 57/58.89; 148/145; 148/150

[58] Field of Search ..... 57/34 R, 58.89; 148/145, 150

[56] References Cited

U.S. PATENT DOCUMENTS

| | | | |
|---|---|---|---|
| 2,380,385 | 7/1945 | Buffum | 148/145 X |
| 3,439,487 | 4/1969 | Landwehrkamp et al. | 57/58.89 |
| 3,532,333 | 10/1970 | Dehn | 148/145 |
| 3,875,732 | 4/1975 | Ellingham | 57/58.89 |
| 3,943,691 | 3/1976 | Mizon et al. | 57/58.89 |
| 4,008,561 | 2/1977 | Grau | 57/58.89 X |
| 4,043,847 | 8/1977 | Just | 148/150 X |
| 4,070,814 | 1/1978 | Goldammer et al. | 57/58.89 X |
| 4,078,370 | 3/1978 | Dreger | 57/58.89 X |

FOREIGN PATENT DOCUMENTS

| | | | |
|---|---|---|---|
| 2558738 | 12/1975 | Fed. Rep. of Germany | 57/58.89 |

OTHER PUBLICATIONS

Mechanical Engineers Handbook, Lionel Marks, Fifth Edition, 1951 (pp. 559–562).

*Primary Examiner*—Donald Watkins
*Attorney, Agent, or Firm*—Donald H. Feldman

[57] ABSTRACT

Disclosed is a method of manufacture of a rotor for the open end spinning of staple fibres into yarn which is formed of a steel and has hardened surfaces at its fiber contacting and collecting surfaces, wherein the rotor may be fashioned by machining from a block of steel or formed from sheet steel, then hardening its internal fiber contacting surfaces by induction heating or carburizing or nitriding or carbonitriding at least in the region of the rotor's maximum diameter, then quenching and thereafter stress-relieving the entire rotor. Such method provides a rotor with exceptional properties of wear resistance in the area most prone to abrasive wear which latter otherwise reduces the rotor's useful service life and substantially increases yarn processing costs.

20 Claims, 1 Drawing Figure

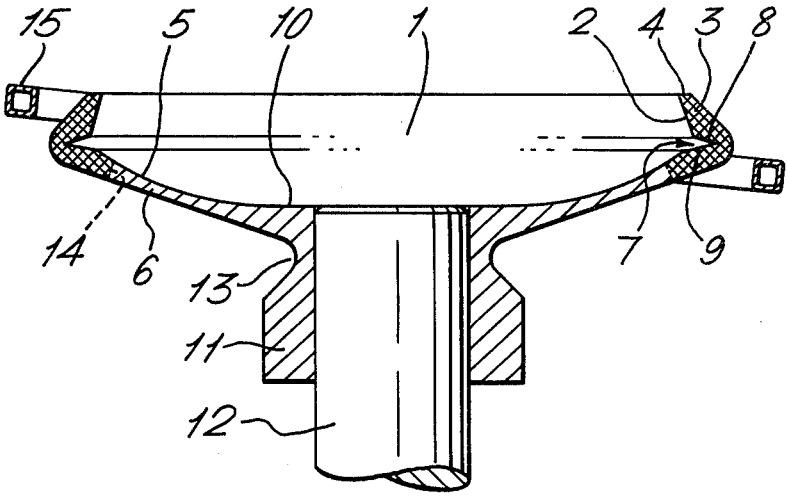
15
5
10
1
2
4
3
8
14
6
13
7
9
11
12

STEEL ROTOR WITH HARDENED FIBRE COLLECTING GROOVE AND METHOD OF MANUFACTURE THEREOF

FIELD OF THE INVENTION

This invention relates to open end yarn spinning machines also known as "rotor spinners," and in particular relates to steel rotors therefore and to a method for their manufacture.

BACKGROUND OF THE INVENTION

In the rotor spinning of yarns from staple fibers, fibers as discrete entities are fed continuously to the cavity within the rotating rotor where they continuously collect at its internal surface of maximum diameter, and from which they are withdrawn continuously as a twisted, elongate strand of yarn.

One problem encountered in the operation of such rotors is a pronounced tendency for wear of the internal collecting surfaces which are incessantly contacted by the staple fibers in their movement to the aforesaid surface of maximum diameter and in the incessant twisting of such fibers at such surface as they are pulled and withdrawn therefrom as yarn. This problem is particularly acute in the region of maximum diameter where abrasive action in the twisting of fibers and in their being pulled from such region as yarn causes rapid wear. The deleterious effects of such wear are particularly grievous in rotors having their region of maximum diameter in the form of a very precisely "V" shaped fiber collection groove, and wherein the sides of the "V" are formed at a small acute angle to one another of precise geometry and having dimensions within very close tolerances. Rotors in commercial usage have such requirements in order to produce uniform yarns of acceptable tensile strengths. Both the degree of precision and the closeness of tolerances of the dimensions at the groove which are required in manufacture become more important in the fabrication of rotors intended to spin finer and yet finer counts of yarn. While any wear of the collecting surfaces and at the groove will adversely affect the quality of the spun yarn, the problem of wear affecting both the durability or useful life of the rotor and the quality of yarn obtained becomes virtually intolerable for rotors, in the present state of the art, which are fabricated to produce the finer counts of yarn. Such problem is manifest in the commercial production of fine counts of yarn with present day rotors formed of aluminium alloy materials by extremely short useful lifetines, even as short as several months, before replacement of the rotor is required. In this, abrasive wear at the groove has been observed even to wear through the rotor shell at diverse points, an unfortunately common situation with aluminum alloy rotors. Respecting the yarn produced, as it progressively cuts into the rotor's groove and abrades the sidewalls thereof, the groove changes its geometry and dimensions, to produce progressively less uniform yarns of progressively reduced tensile strengths. This results in yarn unsuitable for further processing as well as imparting the high costs of yarn wastage, loss of production, and replacement of rotors at frequent intervals.

The prior art has recognized these problems and has suggested several approaches for solving them. For example, in West German Offenlegungschrift No. 2,551,045, a more wear resistant surface was proposed in the form of a ceramic insert bonded to the interior of the rotor shell. However, as is quickly recognized by those skilled in the art the formation of smooth ceramic surfaces to the extremely close tolerances and to the very precise geometries of grooves which are demanded in the fabrication and use of present day rotors is extremely difficult and most delicate, and thus is most expensive. Beyond this the firm bonding of the ceramic insert to the interior of the rotor's metal shell such that the bonding will remain sound and still retain dimensional stability both at the high temperatures and under the great forces generated in the extremely rapid rotation of the rotor over prolonged intervals of time creates another substantial problem, a satisfactory solution to which is yet to be proposed. Even further to provide such a rotor which is well balanced in all dimensions and in density and weight for the extremely rapid rotations required in modern practice presents yet another as yet unaddressed problem.

Analogous problems are inherent in the suggestion by U.S. Pat. No. 3,439,487 to provide an insert, or lining, or coating joined to the interior surfaces of the rotor shell and that the shell and the surface coverings be of dissimilar substances.

In yet another suggested approach by West German Offenlegungsschrift No. 2,239,654, the rotor would be formed of carbon fiber reinforced plastic. Such fibers, a product of space-age technology, are noted for exceptionally high tensile strength and heat ablative qualities, and also very high costs. The suggestion to use a plastic rotor reinforced with these fibers possesses the virtue of providing the light weight desired to minimize power consumption in accelerating and braking the rotor. However, the questions remain as to whether such a composite can be effective in resisting the high continual abrasion to be endured and yet retain its critical dimensions for prolonged periods, as well as retain its geometric integrity under the centrifugal and centripetal forces and heat generated in commercial use. Plastic materials are notorious for their "plastic flow" qualities under just such conditions. In rotors, even minor degrees of plastic flow would be intolerable respecting maintenance of the precise degree of balance required of the rotor in its running as well as in retention of the high degree of geometric accuracy required of the fiber contacting surfaces especially at its fiber accretion groove. The suitability of such suggested composites for present use is in grave doubt.

In yet another approach addressing the problem of rotor weight, it was suggested in U.S. Pat. No. 3,943,691 that one form the rotor of sheet steel, this having the advantages of providing not only a rotor of usable weight but also smooth fiber contacting surfaces. However, as is known in the art, sheet steel is usually of low carbon content which places its ability to endure the incessant abrasion by fibers in doubt.

OBJECTS OF THE INVENTION

It is an object of this invention to provide steel rotors for open end spinners which are unusually resistant to the abrasive wear in processing staple fibers to yarn and which may be fabricated to close tolerances and retain the same through prolonged usage.

Another object of the invention is to provide a method to manufacture such a steel rotor.

SUMMARY OF THE INVENTION

The foregoing objects of the invention are attained in providing a steel rotor of the invention by machining the rotor from a prescribed carbon steel; treating its area of maximum diameter, such as by heating to a sufficient temperature and for a sufficient period, to harden its internal fiber-contacting walls, and then quenching to a prescribed temperature for an interval sufficient to complete the hardening of such walls, and then relieving stress and embrittlement induced thereby by stress-relieving the entire rotor at a prescribed temperature for an interval sufficient therefor.

THE DRAWING

The FIGURE in side elevation, partially in section, shows a rotor of the invention manufactured by its process.

PREFERRED EMBODIMENT

With reference to the FIGURE, a cavity 1 within the rotor is defined by an inner surface 2 of an upper frusto-conical wall 3 extending downwardly and outwardly from a rotor rim 4 and a curved inner surface 5 of a lower frusto-conical wall 6 extending downwardly and inwardly from a region of maximum diameter of the cavity 1. At the region of maximum diameter of the cavity 1 is a V-shaped fiber-collecting groove 7 having, respectively, upper and lower surfaces 8, 9 converging towards an apex. The cavity 1 has a base 10 which joins the inner surface 5 of the lower wall 6 in a smooth curve so that, in operation, favourable stress conditions are produced. A boss 11 depends from the lower end of the rotor which is bored so as to receive a shaft 12 on which the rotor is fixedly mounted. At the junction of the boss 11 with the lower wall 6 an annular recess 13 is formed which permits, when rotating at high speeds, flexing of the upper and lower walls 3, 6 about the recessed portion. By so permitting the rotor to flex in this manner, the stability of the rotor mounting on the shaft 12 is maintained.

Although a preferred rotor construction is here shown, it will readily be appreciated that other suitable constructions may be formed by the method of the invention.

In operation, the rotor is rotated at high speed and fibers in discrete form are delivered into the cavity 1. Under the effect of centrifugal forces the fibers accumulate within the fiber-collecting groove 7 where they are compacted between the converging surfaces 8, 9.

The accumulated fibers are removed from the groove 7 as they are twisted into the tail end of the continuously formed yarn which is removed from the cavity 1 through a doffing tube (not shown) located at the open end of the cavity 1, or through a passage provided in the rotor supporting shaft 12.

The impingement of the fibers on the upper internal surface 2 and the lower internal surface 5, particularly in the region of the groove 7, and the twisting action of the tail end of newly spun yarn in the groove 7 causes these regions of the rotor to wear.

According to the invention the present steel rotor is preferrably formed by turning it from a cylindrical steel bar having a carbon content within the range of from 0.37 percent to 0.47 percent (American Iron and Steel Institute's standard carbon steels numbers 1040 or 1042) and preferrably in the range of from 0.4 percent to 0.45 percent carbon content. Such steel in its unhardened state allows machining without the use of special machine tools and thus permits manufacture of the rotor shape by conventional machine tools as used in the manufacture of the known aluminum alloy rotors.

After the rotor has been formed, the steel is hardened by heat treatment at least in the area indicated above a broken line 14, i. e. in the region of the maximum diameter of the rotor. As seen in the drawing the outer portion of the rotor subjected to treatment includes the whole of the upper wall 3 and an adjacent upper portion of the lower wall 6. Since the rotor is manufacture from steel, the thickness of the upper and lower walls is small as compared with the thickness of the upper and lower walls of an equivalent aluminum alloy rotor. Thus the specific weight of the rotor is reduced so as to be suitable for high speed rotation.

The heat treatment process includes locating a high-frequency induction coil 15 so as to extend around the outside of the rotor 1 in the vicinity of the area above the broken line 14 and connecting the coil 15 to the output terminals of a high-frequency alternating current generator. The coil 15 consists of a single turn of copper tube of square cross-section which is inclined with respect to the rotary axis of the rotor. If desired, the coil may be positioned within the cavity at the upper region thereof. The coil 15 may comprise a plurality of turns.

The rotor is rotated within the coil 15 and the current flowing through the coil 15 sets up an alternating current in the material of the rotor whereby the steel is heated to a temperature above its upper critical limit i. e. in the region of 850° C. After a few seconds, the generator is switched off and the rotor immersed in an aqueous quenching solution. Preferably, the degree of cooling severity is between that of water and oil. Thus the portion of the rotor subjected to induction heating is caused to harden in relationship to the unheated portion.

As a result of this heat treatment process, the steel is in a hard but very brittle condition and with high internal stresses. These internal stresses are relieved by reheating the whole steel rotor to a temperature in the range of 150° C.–700° C. Preferably the stress relieving temperature is in the region of 180° C.–200° C.

The induction heating method of hardening the rotor has been found to be particularly suitable and it results in the hardening of the surfaces contacted by the fibres. It is extremely important that the groove surfaces and the apex thereof are hardened since it is essential that the groove maintains its shape for long spinning periods so that acceptable yarn is produced. The hardness value of the surface of the hardened portion lies within the range of Rockwell C 45.3 to C 62 hardness values, corresponding to 450–750 Vickers Pyramid Numbers and preferably in the region of Rockwell C 57.8 hardness value, cprresponding to 650 Vickers Pyramid Number.

However, other methods of heat treatment, such as carburizing, nitriding or carbonitriding may also be used to produce the necessary hard-wearing rotor surfaces.

In some rotor forms it may be sufficient to harden only the area of the upper wall 3 and the lower wall 6 in the vicinity of the groove 7. The depth of hardening need not penetrate the whole thickness of the upper and lower walls in order to form case hardened surfaces.

The method of this invention may also be applicable to certain steel rotors formed from sheet or plate steel, wherein the rotor is generally formed as is described in U.S. Pat. No. 3,943,691 and then processed according to present teachings so as to enhance its abrasion resistance quality and to prolong its useful service life.

While a preferred embodiment has been described in detail, as well as the advantages obtained in practice of the invention, one of ordinary skill in the art in view of these teachings will be enabled to think of many diverse variations from the specific conditions set out, materials of construction, geometries and contours to devise yet other steel rotor constructions having hardened, fiber-contacting and collection surfaces and to produce them using the present method, all of which fall within the definitions of the invention which are now claimed.

That which is claimed is :

1. In a process for manufacturing a rotor having an internal surface of revolution defining a cavity therewithin for open-end spinning, the improvement comprising forming said rotor from steel, heat-treating a portion of said rotor including its largest diameter of said surface at a prescribed temperature and for a prescribed interval sufficient to harden the surfaces of said portion, quenching said heated portion for a prescribed interval to a prescribed temperature sufficient to complete said hardening, and stress-relieving said rotor at prescribed temperatures for prescribed intervals sufficient to relieve stresses within said steel.

2. The improvement as in claim 1, wherein said forming is by machining said rotor from a bar of steel.

3. The improvement as in claim 1, wherein said forming is by bending sheet steel into the rotor configurations.

4. The improvement as in claim 1, wherein said steel is in the range of from 0.37 to 0.47 percent carbon content.

5. The improvement as in claim 4, wherein said range of carbon content is from 0.40 to 0.45 percent.

6. The improvement as in claim 1, wherein said forming includes forming a fiber collection groove at said portion.

7. The improvement as in claim 6, wherein said heating is by induction coil.

8. The improvement as in claim 1, wherein said heating and quenching temperatures and intervals are sufficient to provide said case hardening within the range of Rockwell C 45.3 to C 62 hardness values.

9. The improvement as in claim 8, wherein said hardening is to a Rockwell C 57.8 hardness value.

10. In a rotor for an open-end spinner having an internal surface of revolution defining a cavity therewithin, said surface having a region of maximum diameter for the collection of staple fibres thereat and for their withdrawal therefrom as an elongate twisted yarn strand, the improvement comprising said rotor being formed according to the process of claim 1 wherein said surface in said region of maximum diameter is of hardened steel.

11. The improvement as in claim 10, wherein said rotor in said region of maximum diameter has an internal fibre collection groove the surfaces of which are of hardened steel.

12. The improvement as in claim 10, wherein said surface of hardened steel fails within the range of Rockwell C 45.3 to C 62 hardness values.

13. The improvement as in claim 12, wherein said surface of hardened steel has a hardness value of about Rockwell C 57.8.

14. The improvement as in claim 10, wherein said rotor is of steel within the range of 0.37 to 0.47 percent carbon content.

15. The improvement as in claim 14, wherein said rotor is of sheet steel within said range of carbon content.

16. The improvement as in claim 14, wherein said rotor is of steel within the range of 0.40 to 0.45 percent carbon content.

17. The improvement as in claim 14, wherein said rotor is of machined steel within said range of carbon content.

18. The improvement as in claim 10, wherein said cavity is defined by an inner surface of an upper generally frusto-conical wall, and an inner surface of a lower generally frusto-conical wall, said inner surfaces converging to provide said region of maximum diameter having said surface of hardened steel.

19. The improvement as in claim 18, wherein said cavity is further defined by a base and wherein said inner surface of said lower wall is smoothly curved and joined smoothly to said base.

20. The improvement as in claim 18, wherein a boss extends from said lower wall and is formed with a bore for the reception therethrough of a supporting shaft, and wherein said boss is further provided with an annular recessed portion.

* * * * *

UNITED STATES PATENT AND TRADEMARK OFFICE

CERTIFICATE OF CORRECTION

PATENT NO. : 4,167,846

DATED : September 18, 1979

INVENTOR(S) : Jack Shaw; John Whiteley; and Stephen Martin

It is certified that error appears in the above-identified patent and that said Letters Patent are hereby corrected as shown below:

On the face sheet, following "[22] Filed: Feb. 22, 1978"

Insert the following lines:

-- [30] Foreign Application Priority Data

Feb. 25, 1977 [GB] United Kingdom.....8115/77 -- .

Signed and Sealed this

*Fifth* Day of *August 1980*

[SEAL]

*Attest:*

SIDNEY A. DIAMOND

*Attesting Officer*

*Commissioner of Patents and Trademarks*